United States Patent [19]

Uno

[11] Patent Number: 4,530,647

[45] Date of Patent: Jul. 23, 1985

[54] PERISTALTIC PUMP HAVING CONICAL ROLLERS

[75] Inventor: Fumio Uno, Matsuyama, Japan

[73] Assignee: Unolab Co., Ltd., Saitama, Japan

[21] Appl. No.: 578,370

[22] Filed: Feb. 8, 1984

[30] Foreign Application Priority Data

Apr. 1, 1983 [JP] Japan ..... 58-48424

[51] Int. Cl.[3] ..... F04B 43/12

[52] U.S. Cl. ..... 417/477

[58] Field of Search ..... 417/477, 476, 475, 360

[56] References Cited

U.S. PATENT DOCUMENTS 3,955,902 5/1976 Kyvsgaard ..... 417/477

4,178,138 12/1979 Iles ..... 417/477 X 4,201,525 5/1980 Brown et al. ..... 417/477

FOREIGN PATENT DOCUMENTS 58-69570 4/1983 Japan .

*Primary Examiner*—Richard E. Gluck

*Attorney, Agent, or Firm*—Wender Murase & White

[57] ABSTRACT

A fluid pump comprising a pump body and a roller holder having tapered rollers, the axes of which converge on an axis of rotation of the roller holder. A head case of the pump may be integrally formed with or support a pump tube or tubes. In any event, the lower half of the head case has a tapered surface which is complementary with respect to an envelope defined by an outer periphery of the tapered rollers. The head case is easily and removably attached to the pump body from the front side so that the head case with the pump tube or tubes can be simply and quickly replaced. Alignment between the pump body and the roller holder which supports the tapered rollers can be very accurately maintained to increase the reliability of the fluid pump by rotating the adjustable retainer.

10 Claims, 8 Drawing Figures

PERISTALTIC PUMP HAVING CONICAL ROLLERS

BACKGROUND OF THE INVENTION

The present invention relates to a fluid pump for feeding liquid such as blood or medical fluid by sequentially compressing one or more pump tubes, and more particularly to a conical fluid pump including a pump body, a rotor shaft rotatably supported in the pump body, a roller holder mounted on the rotor shaft, a plurality of roller shafts mounted about the periphery of the roller holder such that the axes thereof converge on the axis of the rotor shaft, and a plurality of tapered rollers each rotatably mounted on the roller shaft and having a tapered surface, the envelope defined by the tapered rollers forming a frustoconical shape, also converging on the axis of the rotor shaft said tapered rollers being adapted to sequentially compress the pump tubes in a manner to feed fluid therethrough.

Such a conical fluid pump is disclosed in Japanese Patent Application No. 167630/1981 (Japanese Laid Open Patent Application No. 69570/1983).

In the above-mentioned Japanese Patent Application, the roller shafts and the tapered rollers are inclined in an inward converging fashion, and a guide tube is compressed between the tapered rollers and a complementary tapered inner surface which is formed in a lower half of a conical head and which is secured to the pump body. By providing tapered rollers in place of conventional cylindrical rollers, the urging force on the pump tube can be easily regulated by varying the axial position of the roller holder relative to the conical head.

However, as the tapered rollers incline inwards, the pump tube can be replaced only after removing the roller holder with the tapered rollers from the rotor shaft.

SUMMARY OF THE INVENTION

One object of the present invention is to eliminate the above-mentioned disadvantage.

A further object of the present invention is to provide a fluid pump of the above-mentioned type having an easily removable pump tube.

A still further object of the present invention is to provide a fluid pump having an easily removable head case with a pump tube, both of which can be handled as a disposable unit.

To achieve the foregoing as well as other advantages, the fluid pump according to the present invention includes a roller holder having a plurality of roller shafts which converge outwardly. The tapered rollers are rotatably supported by the roller shafts which also converge outwardly. A head case, which supports a pump tube is removably mounted to the pump body. Thus, the head case and the pump tube can be easily mounted on and removed from the pump body without disturbing other components of the fluid pump. Consequently, the head case with the pump tube can be handled as a disposable unit, which is important when the head case is used as a blood handling component. Cleaning or sterilizing the pump tube in situ in not necessary, and replacement of the pump tube due to wear out or the like is no longer a problem.

According to a preferred embodiment of the present invention, a lateral guide groove is formed on a front lower end of the pump body and a releasable retainer is attached to a front upper end of the pump body. The head case includes an edge which engages the lateral guide groove and which permits the head case to rotate relative to the lateral guide groove, i.e. pivot. A pin secured on the top end of the head case engages a releasable retainer to retain the head case in its operative position.

The present invention will be described in reference to a preferred embodiment, by way of example, and to the accompanying drawings.

DETAILED DESCRIPTION OF A PREFERRED EMBODIMENT

Figure 1:
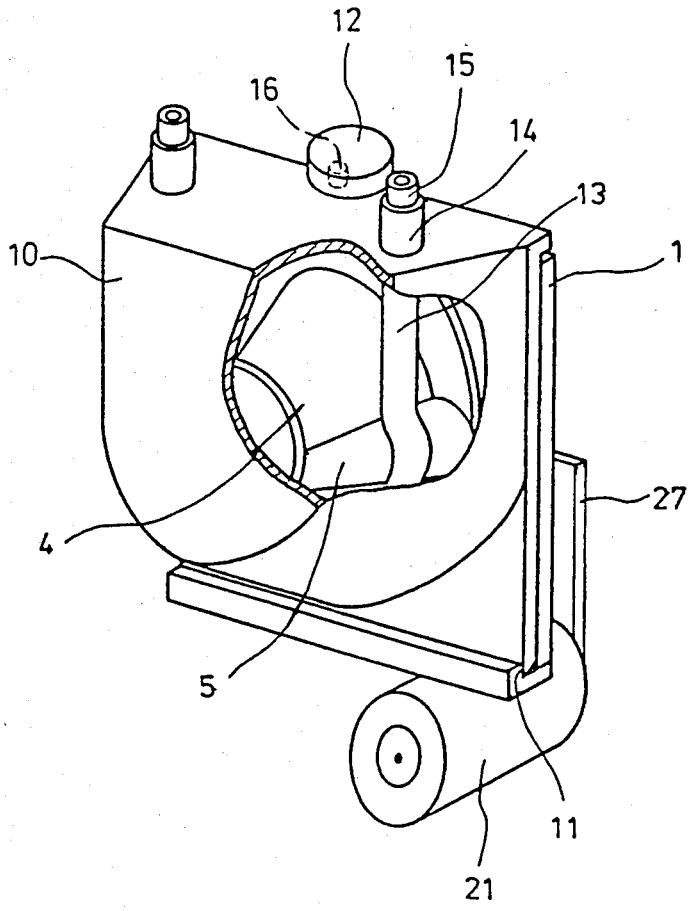
FIG. 1 is a perspective view, with a portion broken away, of a fluid pump, according to the present invention.

FIGS. 1–5 illustrate a fluid pump, according to the invention, which includes a pump body 1 in which a rotor shaft 3 is rotatably supported through bearings 2. The rotor shaft 3 is driven through a pulley 19 and reduction means 22 by a motor 21 as will be described in detail below.

Figure 2:
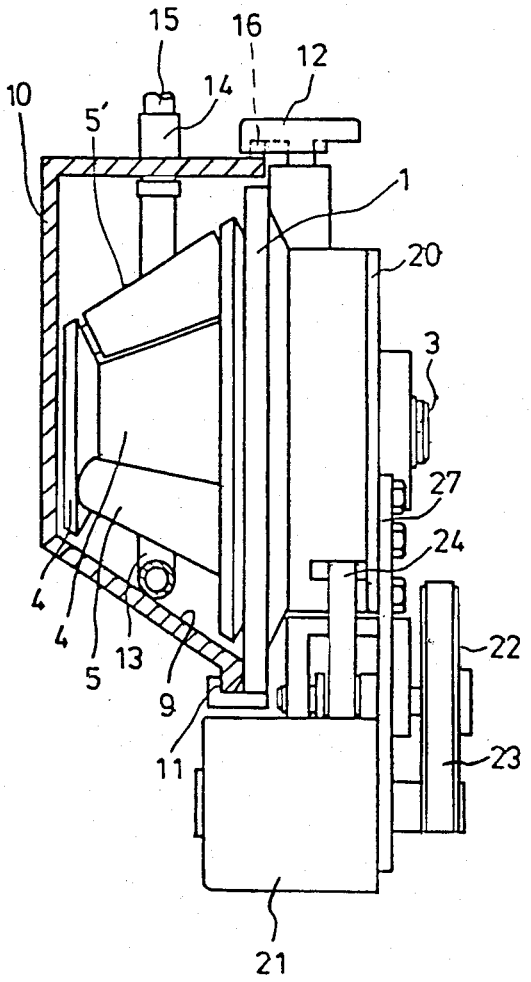
FIG. 2 is a side view of FIG. 1 with a portion of head case in section.
Figure 3:
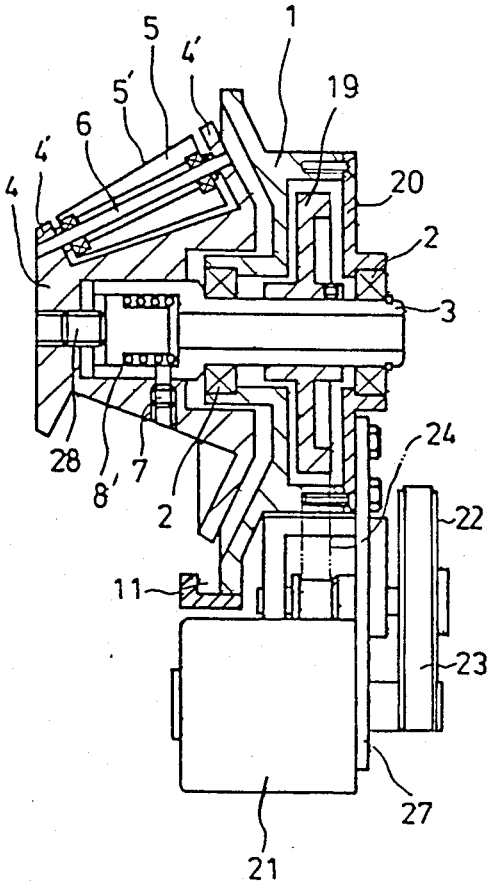
FIG. 3 is a longitudinal sectional view of FIG. 2 with the head case and pump tube removed.

On the left end portion of the rotor shaft 3, as viewed in FIGS. 2 and 3, a generally frustoconical roller holder 4 is mounted, for example, by a set screw 7, the roller holder 4 converges to the left as viewed in FIGS. 2 and 3 according to the present invention. A plurality of tapered rollers 5, for example three as illustrated, which also taper to the left as viewed in FIGS. 2 and 3, are rotatably supported by roller shafts 6 which are secured to peripheral positions about the roller holder 4. The roller holder 4 is provided with front and rear outward franges 4' which act as roller shaft supports. In the illustrated embodiment, roller shafts 6 are equally spaced, i.e. at 120° intervals, about the roller holder 4, and oriented so that the axes of the roller shafts 6 converge at a point on the rotational axis of the rotor shaft 1, i.e. to the left of the shaft 1 as viewed in FIGS. 2 and 3. In an enlarged portion of the rotor shaft 3, a blind opening 3' is formed. A compression spring 8 is disposed between a bottom of the opening 3' and a cover 8'. A spring pressure regulating screw 28 is mounted in a front end of the roller holder 4 to adjust for any clearance between the roller holder 4 and the rotor shaft 3, and also to elastically support the roller holder 4.

A head case 10 is releasably mounted in front of the roller holder 4 by a lateral guide groove 11 of the pump body 1 as shown in FIGS. 1–3 and a releasable retainer 12 which is mounted on a top portion of the body 1 as best seen in FIG. 2. The lower half of the head case 10 has a half frustoconical inner surface 9 which forms a generally uniform clearance between the frustoconical envelope 5' which forms the locus of the tapered rollers 5. The clearance uniformly compresses one or more pump tubes 13 which are secured to an inside surface of the head case 10. Both ends of the pump tube 13 are connected, via connection tubes 14, which are advantageously mounted on and extend through a top wall of the head case 10. The connection tubes 14 connect the pump tubes 13 with external fluid circuit tubes 15. In operation, during rotation of the rotor shaft 3 and the roller holder 4, the tapered rollers 5 compress the pump tube 13 between consecutive roller surfaces and the inside surface 9 of the head case 10 thereby feeding fluid in the tube 13 in the direction of rotation of the rotor shaft 3.

Figure 6:
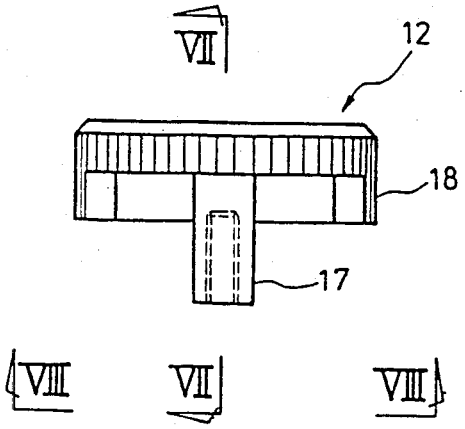
FIG. 6 is an enlarged side view of a releasable retainer of the fluid pump of FIGS. 1 and 2.
Figure 7:
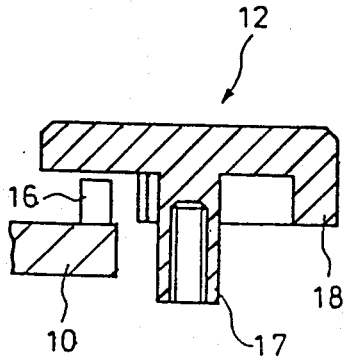
FIG. 7 is a sectional view along line VII—VII of FIG. 6.
Figure 8:
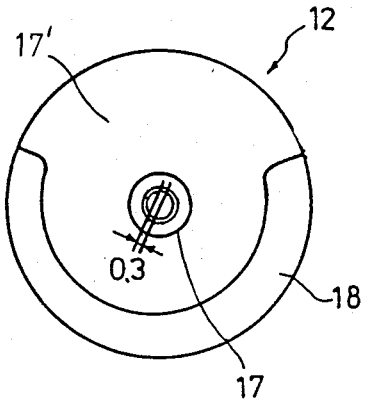
FIG. 8 is a bottom view of FIG. 6.

Details of the releasable retainer 12 are illustrated in FIGS. 6–8 and include a hub 17 which is rotatably supported by means of a pin or stud on top of the pump body 1. Under a disc 17' which is integral with the hub 17, an arcuate projection 18 is formed to engage with a pin 16 mounted on a top surface of the head case 10. The inside surface of the projection 18 is slightly, e.g. 0.3 mm, eccentric with respect to the center of the retainer 12 so that the relative position between the inside surface 9 of the head case 10 and the outer envelope 5' of the tapered rollers 5 can be regulated by rotation of the retainer 12. When the retainer 12 is rotated to release the pin 16 from the arcurate projection 18, the head case 10 with the pump tube 13 can be rotated or pivoted in the lateral guide groove 11 so that the head case 10 can be easily removed from the pump body 1.

Figure 5:
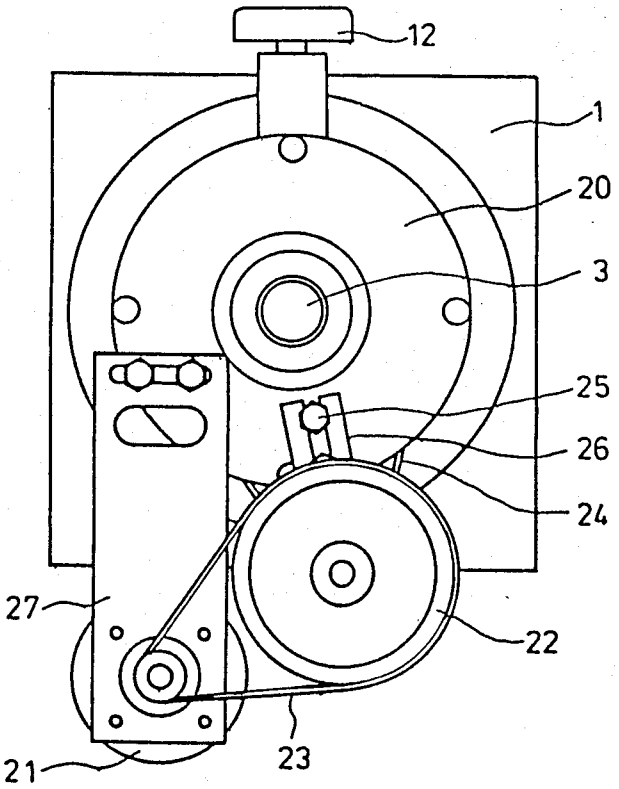
FIG. 5 is a rear view of the fluid pump of FIG. 3.
Figure 4:
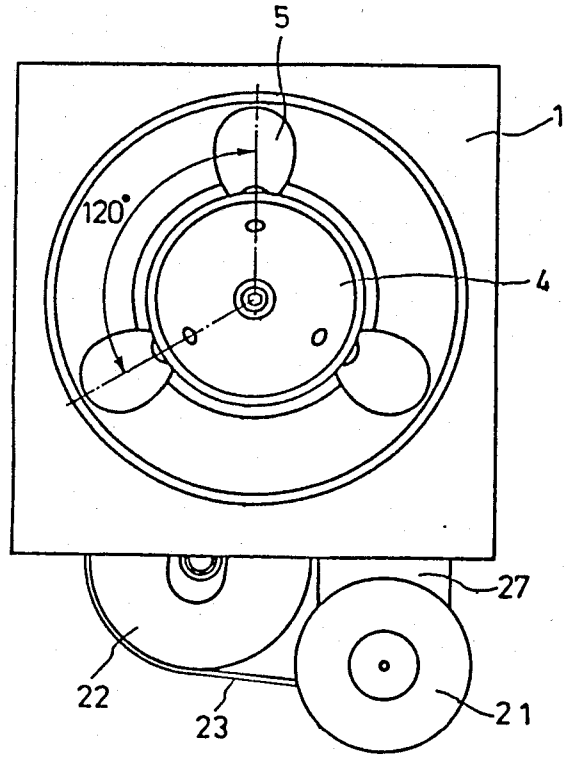
FIG. 4 is a front view of the fluid pump of FIG. 3.

As shown in FIGS. 3–5, the main pulley 19 which is secured to the rotor shaft 3, is enclosed in the pump body 1 by a pulley case 20 which is secured to the body 1. The driving force of the motor 21 is transmitted to the main pulley 19 through a belt 23, reduction means 22, and a belt 24. As shown in FIG. 5, the motor 21 is mounted on a plate 27 which may be secured to the pulley case 20 by means of a suitable fastener, e.g., bolts. The reduction means 22 is mounted on a plate 26 which in turn is adjustably mounted on the pulley case 20, for example, by a bolt 25, to regulate the tension of the belts 23 and 24. In the illustrated embodiment, the reduction means 22 comprises an idler shaft and two pulleys, as is well known in the art.

Operation of the fluid pump will now be described.

After the fluid pump with the roller holder 4 and the motor 21 is assembled, the head case with the pump tube 13 is attached to the fluid pump. More particularly, the lower end of the head case 10 is engaged in the lateral guide groove 11 at the lower end of the pump body 1. Then the head case 10 is rotated about the groove 11, i.e. pivoted, until the pin 16 at the top end of the head case 10 passes within the recess of the arcuate projection 18 of the retainer 12. The retainer 12 is then rotated to retain the pin 16 by means of the arcuate projection 18. Thus, the assembly is completed.

Since the roller holder 4 with the tapered rollers 5 is itself tapered, the head case 10 can be easily attached to or removed from the pump body 1 as desired. Also, as the pump tube 13 is preferably mounted on or secured to the head case prior to attaching the head case 10 to the pump body 1, the positioning of the pump tube 13 in the fluid pump relative to the tapered rollers 5 can be accurately determined when attaching the head case. Fine regulation of the compression of the pump tube 13 by the tapered rollers 5 can be performed by rotation of the retainer 12 by means of the eccentric inner surface of the arcurate projection 18.

Since the head case 10 has simple shape, it can be easily, inexpensively, and accurately formed from any suitable plastic. Since the head case 10 is inexpensive, its as well as the pump tube 13 can be treated as disposable parts, e.g. for only one use. Thus, problems such as cleaning the pump tube, or fatigue of the pump tube by long service, or wear of the portion of the head case which contacts the pump tube thus causing reverse flow of fluid through the pump tube are completely eliminated.

Many variations of the preferred embodiment can be considered to be within the scope of the present invention. For example, in place of the fixed pin 16 on top of the head case 10, an arcuate groove which engages the projection 18 may be formed. The number of the tapered rollers 5 may be selected as desired.

It will be appreciated that the fluid pump, according to the present invention will preferably include a roller holder having tapered rollers, the axes of which converge. The head case of the pump is preferably integrally formed with the pump tube or tubes and has a lower, half tapered surface which is complementary with respect to an envelope defined by the outer periphery of the tapered rollers and which can be easily and removably attached to the pump body from the front side. Thus, the head case with the pump tube or tubes can be simply and quickly replaced. As the construction of the engaging portions between the head case and the pump body is very simple, alignment between the pump body and the roller holder can be very accurately maintained to increase the reliability of the fluid pump. Further, compression of the pump tube can be adjusted simply by rotating the adjustable retainer.

While the invention is described above with reference to a preferred embodiment, it should be understood that the invention should be limited only in accordance with the scope of the appended claims.

What is claimed is:

1. A fluid pump comprising:

a pump body having an adjustable retaining means;

a rotor shaft rotatably supported in the pump body and having an axis of rotation;

at least one roller shaft mounted about said rotor shaft axis of rotation, said roller shaft having axis of rotation which intersects said rotor shaft axis of rotation and which is directed away from said pump body;

a tapered roller rotatably mounted on said roller shaft and comprising a generally truncated frustoconical surface, said tapered roller defining a frustoconical rotational envelope centered on said rotor shaft axis of rotation, an apex of said frustoconical envelope being directed away from said pump body;

a removable head case supported on said pump body by said adjustable retaining means for at least partially enclosing said tapered roller, said head case having a generally frustonconical inner surface generally complementary with and opposing at least a portion of said frustoconical rotational envelope to form an adjustable gap therebetween;

at least one fluid pump tube disposed in said adjustable gap to be compressed between said tapered roller and said generally frustoconical inner surface.

2. The fluid pump of claim 1, in which said head case supports said fluid pump tube.

3. The fluid pump of claim 1, wherein said adjustable retaining means comprises a lateral groove and a releasable retainer and said head case further comprises a first end for engaging said lateral groove to allow said head case to pivot about the lateral groove, and means for engaging said releasable retainer.

4. The fluid pump of claim 1 further comprising a plurality of roller shafts having axes convergent with the rotor shaft axis of rotation and a plurality of tapered rollers each mounted on a respective one of said roller shafts, wherein a periphery of said plurality of tapered roller defines said frustoconical rotational envelope and wherein said fluid pump tube is sequentially compressed between consecutive tapered rollers and said generally frustoconical inner surface.

5. The fluid pump of claim 1 wherein said fluid pump tube is integrally formed with said head case.

6. The fluid pump of claim 3 wherein said releasable retainer comprises a hub member rotatably supported on said pump body, and an arcuate projection spaced from said hub for cooperating with said engaging means.

7. The fluid pump of claim 3 wherein said engaging means comprises a pin projecting from said head case.

8. The fluid pump of claim 6 wherein said engaging means comprises a pin projecting from said head case.

9. The fluid pump of claim 6 wherein said arcuate projection is eccentric with respect to said hub whereby the postion of the generally frustoconical inner surface of the head case relative to the frustoconical rotational envelope can be adjusted by rotation of said releasable retainer.

10. The fluid pump of claim 4 wherein said adjustable retaining means further comprises means for adjusting the compression on said fluid pump tube.

* * * * *